United States Patent [19]

Hinely et al.

[11] 4,395,951

[45] Aug. 2, 1983

[54] WATER-ARMED/AIR-SAFED RELEASE APPARATUS

[75] Inventors: Douglas M. Hinely, Rockville; Louis J. Montesi, Silver Spring; Robert R. Durrell, Columbia, all of Md.; Charles W. Goode, Washington, D.C.

[73] Assignee: The United States of America as represented by the Secretary of the Navy, Washington, D.C.

[21] Appl. No.: 230,577

[22] Filed: Feb. 2, 1981

[51] Int. Cl.[3] ..... F42C 3/00; F42C 5/00

[52] U.S. Cl. ..... 102/223; 102/229; 102/414; 102/416; 294/83 AA; 294/83 AE; 89/1 B

[58] Field of Search ..... 102/223, 229, 392, 414, 102/416; 89/1 B; 294/83 AA, 83 AE

[56] References Cited

U.S. PATENT DOCUMENTS

| | | | |
|---|---|---|---|
| 2,660,952 | 12/1953 | Mohaupt | 102/223 X |
| 2,996,990 | 8/1961 | Leaman | 102/223 |
| 3,242,666 | 3/1966 | Peterson | 294/83 AA X |
| 3,245,346 | 4/1966 | Schuetzler | 294/83 AA X |
| 3,511,183 | 5/1970 | Geffner | 102/229 |
| 3,532,057 | 10/1970 | Aubrey | 102/229 |
| 3,577,926 | 5/1971 | Schuemann | 102/223 X |
| 3,609,825 | 10/1971 | Pullos | 294/83 AA X |
| 3,628,821 | 12/1971 | Reece | 294/83 AA |
| 3,754,496 | 8/1973 | Noel | 102/416 X |
| 3,765,331 | 10/1973 | Montesi | 102/416 |
| 3,765,332 | 10/1973 | Baker et al. | 102/416 |
| 4,311,097 | 1/1982 | Backstein et al. | 102/416 X |

FOREIGN PATENT DOCUMENTS

| | | | |
|---|---|---|---|
| 979155 | 12/1950 | France | 294/83 AA |

*Primary Examiner*—David H. Brown
*Attorney, Agent, or Firm*—R. S. Sciascia; A. L. Branning; J. G. Wynn

[57] ABSTRACT

An improved release apparatus, including an actuator device, a release device and a firing device, releases the firing device in a water environment and not in an air environment when the actuator device is remotely actuated. When in a water environment, a predetermined gas pressure from the actuator device drives forward a pusher piston and valve sleeve arrangement, disposed in a water chamber of the release device, initially to close off lower entry/exit orifices in the water chamber by action of the valve sleeve, and then to compress an entrapped column of water to a predetermined water pressure sufficiently to cause shearing off of an annular lip of a ball lock piston thereby separating the firing device from the release device. When in an air environment, the pressure from a compressed entrapped air column is not sufficient to cause shearing off or folding down of the annular lip of the ball lock piston, and, accordingly, the release apparatus is safed.

9 Claims, 2 Drawing Figures

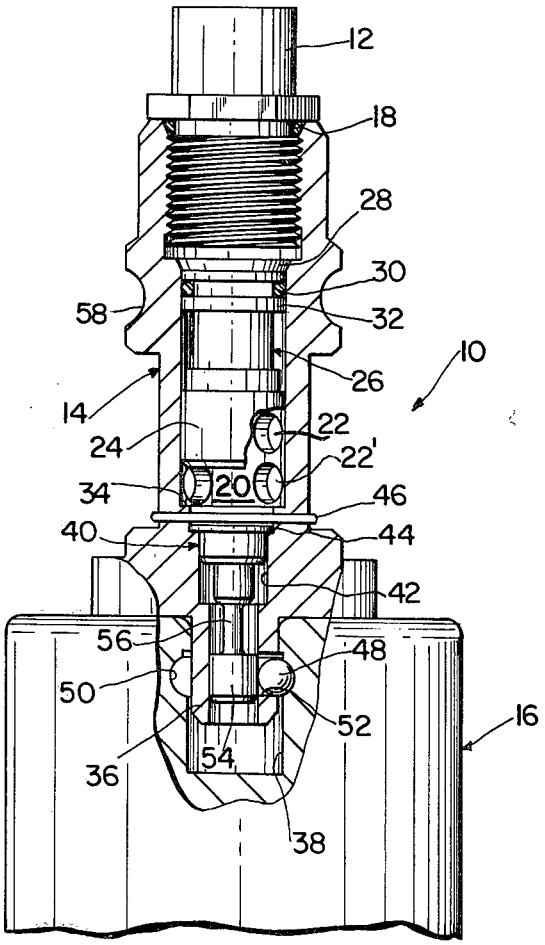
FIG. 1
FIG. 2
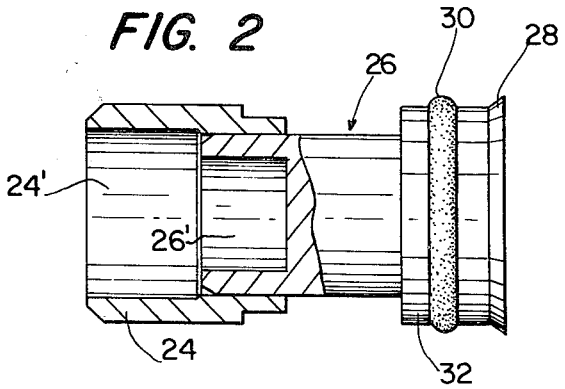

WATER-ARMED/AIR-SAFED RELEASE APPARATUS

BACKGROUND OF THE INVENTION

1. Field of the Invention

This invention relates generally to an improved water-armed/air-safed ordnance apparatus, and more particularly to an explosively actuatable pusher piston and valve sleeve arrangement in combination with a ball lock piston type mechanism to assure positive separation of a firing device from a release device in a water environment while assuring added protection against inadvertent out-of-water-operation.

2. Description of the Prior Art

Ball lock piston type mechanisms are well known in the prior art. They have been used in the past, in combination with explosive actuators, to cause remote release or separation of a firing device and/or payload package (explosive firing devices and line charges), from, for example, a non-expendable pod attached to a launching vehicle flying over a water environment.

One such apparatus using, inter alia, a ball lock piston type mechanism, is disclosed in U.S. Pat. No. 2,996,990 to Leaman, entitled "Explosive Actuator", filed Oct. 15, 1953, and assigned to the same assignee as the present invention. In Leaman, an actuatable apparatus provides for release of a ball type locking device when an explosive charge, sealed within the body of the apparatus, is fired in response to an electrical impulse.

According to Leaman, a high pressure gas from an explosive actuator is confined to a sealed chamber intermediate a ball detent plunger (piston) and the aforementioned explosive actuator. The high pressure gas generated in the sealed chamber is predetermined and sufficient to cause release of the plunger (piston) by shearing off a conical flange portion (lip) thereof. While, Leaman, discloses specific mechanisms for explosive actuation and ball detent release of payloads and the like, he does not consider water-armed/air-safed functions and features which today is considered an important operational function of apparatus of this class and kind.

Consequently, in a water environment, proper operational techniques require separation of a payload or firing device from a pod only when the pod is underwater safely away from the launching vehicle. In addition, for safety of personal and property, this separation must not occur when the device is inadvertently actuated in an air environment.

As stated, ball locking mechanisms used in situations as described hereinabove do not provide the required out-of-water safety. Accordingly, there is a need in the prior art, when using ball lock piston type mechanisms in combination with release devices, actuator devices and firing devices to be able to remotely release a firing device in a water environment and not in an air environment while assuring positive separation in the water environment and providing improved out-of-water protection.

A recent design added a water-armed/air safed feature to an apparatus similar to the one disclosed in Leaman. This design contemplated driving a ball lock piston type mechanism via a water column using only the high gas pressure of an explosive actuator (squib) to compress the water column. The pressure generated by this technique is not sufficient to reliably drive the apparatus of the present invention and maintain safe out-of-water protection. However, the technique has been used with hand grenades and like devices with some success. For example, see U.S. Pat. No. 3,765,332 to Baker et al, entitled, "Water-Armed, Air-Safetied [sic] Detonator", filed Mar. 27, 1972, and assigned to the same assignee as the present invention.

Another recent design revised the foregoing design by adding a primary piston for compressing the water column. This design is disclosed in U.S. Pat. No. 3,765,331 to Montesi, also entitled, "Water-Armed Air Safetied [sic] Detonator", filed Apr. 11, 1972, and assigned to the same assignee as the present invention. In Montesi, a water-armed/air-safed fuze device for use with hand grenades, mines, bombs and the like permits initiation of a main charge connected thereto only when the device is under water.

According to Montesi, a chamber having orifices opened to the environment is intermediate an explosively driven piston (primary piston) and a percussion primer. When water fills the chamber it is compressed by the explosively driven piston causing shearing off of the lip of a firing pin. The firing pin is then ejected into the percussion primer thereby initiating the main charge. When air fills the chamber and is compressed, the pressure generated is insufficient to shear off the lip of the firing pin, and, accordingly, the device is safed.

While Montesi discloses a device that operates to capture a column of water and then compress that column to generate a driving pressure for a primary piston, the normal compression of the water causes an appreciable amount thereof to escape through the orifices thereby decreasing the available drive pressure. The available drive pressure is possibly sufficient to reliably operate Montesi's device when used with firing pins in hand grenades and the like. However, it is not large enough to reliably operate the ball lock piston type mechanism contemplated for use with the present invention since it was found that the resultant pressure was not sufficient to shear off the annular lip of the ball lock piston used. Also, it was found that reducing the strength of the annular lip of the ball lock piston resulted in a safety comprise from an inadvertent initiation in an air environment specifically, or from vibration and shock in general.

Thus, there is a need in the prior art to increase the available device pressure when compressing a column of water sufficiently to shear off the annular lip of a ball lock piston type mechanism while maintaining improved protection against out-of-water operation when the apparatus is inadvertently actuated in air or subjected to shock and vibration.

An additional problem with the prior art water-armed/air-safed apparatuses of the class and kind of Montesi and Baker et al, is that when they are inadvertently submerged in water and subsequently retrieved, they become unsafe in air due to the difficulty of entrapped water to escape. Thus, they can cause property damage and injury or death to an unwitting user and other personnel in the area.

Hence, there is a need in the prior art to configure a water-armed/air-safed release apparatus in an improved manner so that it is safe to handle in air even when inadvertently submerged in water and subsequently retrived without actuation.

The representative prior art, as outlined hereinabove, include many advances in release or separation apparatus with water-armed/air-safed features including primary pistons. However, insofar as can be determined, no prior art water-armed/air-safed release apparatus incorporates all of the features and advantages of the present invention.

OBJECTS OF THE INVENTION

Accordingly, an important object of the present invention is to assure positive separation of a firing device in a water environment in an improved and reliable manner.

A further object of the present invention is to configure an improved water-armed/air-safed release apparatus by combining a ball lock piston and a water-armed-/air-safed mechanism in an improved manner.

Still a further object of the present invention is to prevent accidental separation of a firing device in air in an improved manner.

Another object of the present invention is to maintain safe handling of a water-armed/air-safed release apparatus in air after it has been submerged in water.

Still another object of the present invention is to increase the margin of safety between a desired water separation and an undesired air separation of a firing device from a release device.

Yet another object of the present invention is to increase the available water pressure for separation while maintaining improved protection against out-of-water operation.

SUMMARY OF THE INVENTION

In accordance with these, other objects, features and advantages, the present invention has as its primary purpose to assure a positive separation action when a water-armed/air-safed release apparatus is actuated in water while providing improved out-of-water action when it is inadvertently actuated in air or subjected to shock and vibration. The essence of the improvement is increasing the available water pressure for separation of the firing device in a water environment, while maintaining and improving the protection against inadvertent out-of-water operation. The water-armed/air-safed release apparatus is configured to operate to capture a column of water, seal the column of water from the water environment and then compress it sufficiently to drive a ball lock piston thereby shearing off an annular lip thereof. Thus, in water-armed/air-safed apparatus of the class and kind disclosed, sealing the column of water from the water environment before compression results in an increase in the available water pressure and is a novel feature of the present invention.

The foregoing is accomplished by operatively connecting a release device intermediate to an actuator device and a firing device such that the firing device is separated only when in a water environment. When the actuator device is remotely actuated a predetermined gas pressure is generated from a squib therein thereby causing an annular lip of a pusher piston to shear off which causes the pusher piston and a valve sleeve arrangement to translate forward in a water chamber of the release device. By action of the valve sleeve, lower entry/exit orifices in a lower portion of the water chamber are sealed off from the external water environment entrapping a column of water in a central recess and a central bore of the pusher piston and the valve sleeve, respectively. Then, by action of the pusher piston, the entrapped water column is compressed to a predetermined water pressure sufficient to shear off an annular lip of a ball lock piston. Concurrently, by action of the pusher piston, water in an upper portion of the water chamber is forced out of upper entry/exit orifices. Since the ball lock piston is operatively disposed in a ball lock piston cavity of the release device intermediate to it and the firing device, continued pressure from the compressed water column causes the ball lock piston to translate forward thereby causing the firing device to separate from the release device.

The water-armed/air-safed release apparatus is safe to handle in an air environment since compressing an entrapped air column does not produce a pressure sufficient to shear off the annular lip of the ball lock piston.

In addition, the water-armed/air-safed release apparatus is safe to handle in an air environment even when submerged in water and subsequently retrieved without actuation, since the lower entry/exit orifices are disposed and configured so that water empties out of the lower portion of the water chamber by gravity.

BRIEF DESCRIPTION OF THE DRAWINGS

The essence and purpose of the present invention, as well as other objects, features, advantages and uses will be apparent from the following more particular description of the preferred embodiment as illustrated in the accompanying drawings, in which:

FIG. 1 is a partially fragmented and partially cut away elevational view of the apparatus according to the invention illustrating the manner in which it is employed in connection with a ball lock piston mechanism part thereof; and FIG. 2 is a view, in partial section, of the pusher piston and valve sleeve arrangement of FIG. 1 showing in better detail how they are operatively mated together.

DESCRIPTION OF THE PREFERRED EMBODIMENT

FIG. 1 shows an embodiment of a water-armed/air-safed release apparatus 10 in which the present invention is employed. An actuator device 12, including an electrically actuatable explosive squib (not shown), is threadedly mounted to a top end of a release device 14. A bottom end of release device 14 is operatively mounted to a firing device 16. A first O-ring type seal 18 disposed between actuator device 12 and the top end of release device 14 seals against water entry and gas exit thereat. Hence, the explosive squib (not shown) is protected against water damage when water-armed/air-safed release apparatus 10 is submerged in water for long periods of time, and when actuated, a predetermined gas pressure generated thereby is maintained.

Referring now to FIGS. 1 and 2 concurrently, a water chamber 20 configured coaxially in release device 14, includes a plurality of upper and lower entry/exit orifices 22 and 22', respectively, and contains a valve sleeve 24 slidably mounted therein. Referring particularly to FIG. 2, a bottom end of a pusher piston 26 including a central recess 26' is light press fitted into a central bore 24' of valve sleeve 24 so that the assembly will translate together when pusher piston 26 is initially translated forward. Aspects of the present invention pertaining to the coaction of valve sleeve 24, pusher piston 26 and upper and lower entry/exit orifices 22 and 22' will be discussed fully in the section entitled, "Statement of the Operation", hereintofollow.

Still referring to FIGS. 1 and 2 concurrently, pusher piston 26 is seated by a pusher piston annular lip 28 integral thereto in an upper portion of water chamber 20. A second O-ring type seal 30, diposed between a pusher piston shoulder 32 and pusher piston annular lip 28 and contiguous to the aforementioned shoulder, and in sealing engagement with the upper portion of water chamber 20, maintains a water and gas seal between water chamber 20 and actuator device 12 so that the explosive squib therein is protected against water damage when water-armed/air-safed release apparatus 10 is submerged in water for long periods of time, and so that when actuated, the predetermined gas pressure generated thereby is maintained against pusher piston 26. Pusher piston shoulder 32 being integral to pusher piston 26 acts as a plunger which forces water in the upper portion of water chamber 20 out of upper entry/exit orifices 22. It also acts as a stop against the top end of valve sleeve 24 when co-acting therewith. A water chamber shoulder 34 in water chamber 20 acts as a stop for valve sleeve 24 during the operation thereof.

Referring again to FIG. 1 specifically, release device 14 is operatively mounted to firing device 16 via an interfacing body portion 36 thereof which mates with a ball lock cavity 38 configured coaxially in firing device 16. A ball lock piston 40 is seated in an upper portion of a ball lock piston cavity 42 by a ball lock piston annular lip 44 integral thereto. Ball lock piston annular lip 44 retards translation of the piston in a forward direction. Additionally, a locking wire 46 extending and keyed through the upper portion of ball lock piston cavity 42 secures ball lock piston 40 against backward translation.

A conventional ball type locking action is provided by three locking balls 48 (one shown) seated in both an annular groove 50 of firing device 16 and three ball openings 52 (one shown) disposed symmetrically about the periphery of interfacing body portion 36 of release device 14. An end body portion 54 of ball lock piston 40 locks locking balls 48 in their respective seats as shown in FIG. 1. An intermediate body portion 56 of ball lock piston 40 being smaller in diameter than end body portion 54 forms a recess between it and ball lock piston cavity 42 which allows locking balls 48 to fall into the recessed area provided when ball lock piston 40 is translated forward. This action causes firing device 16 to separate from release device 14.

STATEMENT OF THE OPERATION

Details of the operation, according to water-armed-/air-safed release apparatus 10 previously described, are explained in conjunction with FIGS. 1 and 2 viewed concurrently.

Release device 14 is installed using a film of grease into firing device 16 by first installing three locking balls 48 (one shown) into three ball openings 52 (one shown) of interfacing body portion 36 of release device 14. Interfacing body portion 36 is then inserted into ball lock cavity 38 of firing device 16. Then ball lock piston 40 is installed, thereby securing release device 14 to firing device 16. Ball lock piston 40 is secured against premature translation by the action of both ball lock piston annular lip 44 and locking wire 46. The mating surfaces of valve sleeve 24 and pusher piston 26 (see FIG. 2) are lubricated with grease and light press fitted together. Second O-ring seal 30 is greased and installed on pusher piston 26. Then the assembly is installed into water chamber 20 of release device 14. First O-ring seal 18 is greased and installed on actuator device 12. Actuator device 12, containing the electrical initiated explosive squib (not shown), is then threaded into the top end of release device 14.

For purposes of the invention and as an example, water-armed/air-safed release apparatus 10 can be used in mine sweeping operations. Accordingly, it is configured to be installed on a pod (not shown) by inserting pins (not shown) at annular groove 58 of release device 14 (see FIG. 1). A life line (not shown) connects the pod to a helicopter (not shown). A plurality of line charges (not shown) are connected to firing device 16 at the end shown as cut away in FIG. 1. These are dragged in the water in the mine infested area.

When desired, an electrical signal, through a cable (not shown) connected to actuator device 12 and secured to the aforementioned life line, remotely actuates the explosive squib in actuator device 12. The predetermined gas pressure (approximately 5,000 psi) generated by actuator device 12 operates to drive the assembly of pusher piston 26 and its mated valve sleeve 24 forward shearing off or folding down pusher piston annular lip 28. Pusher piston 26 and valve sleeve 24 continue to translate forward as a unit closing off lower entry/exit orifices 22', thereby entrapping a column of water in central bore 24' of valve sleeve 24 and central recess 26' of pusher piston 26. The lower end of valve sleeve 24 comes to rest on water chamber shoulder 34 of water chamber 20, thereby forming a water tight seal. Pusher piston 26 then slides down central bore 24' of valve sleeve 24 generating as it moves an increasing pressure on the entrapped column of water. Pusher piston 26 also operates as it moves via pusher piston shoulder 32 to force water entrapped between it and the top end of valve sleeve 24 out of the upper portion of water chamber 20 via upper entry/exit orifices 22. Otherwise, the aforementioned entrapped water would not allow sufficient water pressure to be generated by pusher piston 26 on the entrapped water column.

When a predetermined water pressure of approximately 4000 psi is generated, ball lock piston annular lip 44 is sheared off. As pusher piston 26 continues to translate forward, ball lock piston 40 is caused to translate forward by the water pressure generated causing end body portion 54 to translate forward thereby unlocking locking balls 48 (one shown), and causing intermediate body portion 56 having a reduced diameter from end body portion 54 to translate adjacent locking balls 48. Consequently, the aforementioned balls fall into the recess created by this reduced diameter and ball lock piston cavity 42, thereby causing firing device 16 to separate from release device 14. In a normal mine sweeping operation, the pod is then pull back into the launching vehicle, expended actuator 12 and released device 14 are removed from the pod and another water-armed/air-safed release apparatus is assembled for a subsequent operation.

In an air environment, water-armed/air-safed release apparatus 10 operates in a similar fashion except that an entrapped air column can only be compressed to approximately 50 psi. This pressure is insufficient to shear off ball lock piston annular lip 44. Thus, there is a margin of safety between a desired water separation and an undesired air separation of about 80 to 1.

Additionally, when water-armed/air-safed release apparatus 10 is lowered in and subsequently taken out of a water environment without actuation, it is in the attitude shown in FIG. 1. Thus, it is safe to handle in the air environment when retrieved since lower entry/exit orifices 22' are configured and disposed so that any water in the lower portion of water chamber 20 empties out by gravity.

To these skilled in the art, many modifications and variations of the present invention are possible in light of the above teachings. It is therefore to be understood that the present invention can be practiced otherwise than as specifically described herein and still be within the spirit and scope of the appended claims.

We claim:

1. An improved water-armed/air-safed release apparatus having an actuator device, a release device and a firing device for separating said firing device from said release device in a water environment and not in an air environment, said release device being operatively mated at a bottom end of said firing device and at a top end to said actuator device, said actuator device being configured to generate a predetermined gas pressure when actuated, wherein the improvement comprises:

a water chamber configured coaxially in said release device and including, a water chamber shoulder, a plurality of upper entry/exit orifices and a plurality of lower entry/exit orifices;

a valve sleeve slidable disposed in said water chamber; and a pusher piston operatively coupled at a lower end to a top end of said valve sleeve and operatively seated at a top end to an upper portion of said water chamber such that when said actuator device is actuated, the predetermined gas pressure is generated causing said pusher piston to translate forward pushing said valve sleeve forward against said water chamber shoulder, sealing off said lower entry/exit orifices and opening up said upper entry/exit orifices, thereby entrapping a column of water in a central bore of said valve sleeve and a central recess of said pusher piston, and providing an exit for the water in said upper portion of said water chamber, and such that when said pusher piston translates further forward within said central bore of said valve sleeve, the entrapped column of water therein is compressed to a predetermined water pressure, the water in said upper portion of said water chamber being forced out of said upper-/exit orifices into the water environment.

2. The release apparatus of claim 1 wherein said actuator device is threadably mounted to said top end of said release device and said actuator device further includes, a first sealing means disposed between it and said top end of said release device for sealing against water entry and gas exit.

3. The release apparatus of claim 1 wherein said pusher piston further includes:

a pusher piston annular lip integral with said top end thereof for seating in said upper portion of said water chamber, said pusher piston annular lip being configured to shear off when the predetermined gas pressure is generated;

a pusher piston shoulder disposed adjacent said pusher piston annular lip for forcing the water in said upper portion of said water chamber out of said upper entry/exit orifices, and for stopping said pusher piston against said top end of said valve sleeve; and a second sealing means disposed between said pusher piston shoulder and said pusher piston annular lip and contiguous to said pusher piston shoulder for sealing against water entry and gas exit.

4. The release apparatus of claim 1 wherein said lower entry/exit orifices are configured and positioned in a lower portion of said water chamber to allow water to exit by gravity when said release apparatus is submerged in the water environment and subsequently retrieved without remote actuation.

5. The release apparatus of claim 1 wherein said bottom end of said release device further includes, an interfacing body portion for operatively mating with said firing device, said interfacing body portion having a ball lock piston cavity configured coaxially there in and a plurality of ball openings disposed symmetrically about the periphery thereof.

6. The release apparatus of claim 5 wherein said firing device further includes, a ball lock cavity configured coaxially therein, and an annular groove fabricated in said ball lock cavity for operatively mating with said release device.

7. The release apparatus of claim 6 wherein said ball lock piston further includes:

a ball lock piston annular lip integral with a top end thereof for seating in an upper portion of said ball lock piston cavity;

an end body portion configured to be slidable in said ball lock piston cavity and positioned adjacent said plurality of ball openings when said ball lock piston is secured; and an intermediate body portion intermediate said ball lock piston annular lip and said end body portion and configured to provide a recess adjacent said plurality of ball openings when said ball lock piston is translated forward.

8. The release apparatus of claim 7 further including, a plurality of locking balls for seating into corresponding ones of said plurality of ball openings in said interfacing body portion of said release device, and for seating into said annular groove of said firing device up against said end body portion of said ball lock piston so as to lock said release device and said firing device together.

9. The release apparatus of claim 8 further including, a locking wire for keying through said upper portion of said ball lock piston cavity of said release device proximate to said top end of said ball lock piston and said ball lock piston annular lip for securing said ball lock piston in said ball lock piston cavity against backward translation, said ball lock piston annular lip being configured to shear off when the predetermined water pressure is generated, thereby translating forward until the recess is adjacent said plurality of locking balls whereupon they fall into the recess causing separation of said firing device from said release device.

* * * * *